US008317395B2

(12) United States Patent
Carr et al.

(10) Patent No.: US 8,317,395 B2
(45) Date of Patent: Nov. 27, 2012

(54) STACK CARRIER

(75) Inventors: Kimberly M. Carr, Elmont, NY (US); Lauren Grassia, East Northport, NY (US); Denise Ceron, Syosset, NY (US)

(73) Assignee: Esselte Corporation, Melville, NY (US)

( * ) Notice: Subject to any disclaimer, the term of this patent is extended or adjusted under 35 U.S.C. 154(b) by 852 days.

(21) Appl. No.: 12/188,579

(22) Filed: Aug. 8, 2008

(65) Prior Publication Data

US 2009/0041393 A1 Feb. 12, 2009

Related U.S. Application Data

(60) Provisional application No. 60/955,274, filed on Aug. 10, 2007.

(51) Int. Cl.
*B65D 33/16* (2006.01)

(52) U.S. Cl. ..... 383/63; 383/35; 206/39.1

(58) Field of Classification Search ..... 383/35, 383/40, 41, 63, 65, 66, 106; 206/39.1, 39.7, 206/424

See application file for complete search history.

(56) References Cited

U.S. PATENT DOCUMENTS

| | | | | |
|---|---|---|---|---|
| 5,249,827 | A * | 10/1993 | Olson | 283/36 |
| 5,664,296 | A | 9/1997 | May | |
| 5,775,496 | A * | 7/1998 | Cyr | 206/316.1 |
| 6,199,737 | B1 * | 3/2001 | Ringelstetter | 224/675 |
| 6,471,120 | B1 | 10/2002 | Vogel | |
| 6,923,302 | B2 * | 8/2005 | Godshaw et al. | 190/109 |
| 7,204,641 | B2 | 4/2007 | Stolmeier | |

FOREIGN PATENT DOCUMENTS

| | | |
|---|---|---|
| JP | 57-71053 | 4/1982 |
| JP | 2001348041 | 12/2001 |
| WO | WO 2005/019052 | 3/2005 |

OTHER PUBLICATIONS

International Search Report for International Application No. PCT/US2008/072646 filed Aug. 8, 2008.
International Preliminary Report on Patentability for International Application No. PCT/US2008/072646 filed Aug. 8, 2008.
Office Action for Canadian Patent Application No. 2,695,922 issued May 31, 2011.
1st Office Action for Chinese Patent Application No. 200880109718.7 issued May 27, 2011.
2nd Office Action for Chinese Patent Application No. 200880109718.7 issued Apr. 1, 2012.

* cited by examiner

*Primary Examiner* — Nathan J Newhouse
*Assistant Examiner* — Christopher Demeree
(74) *Attorney, Agent, or Firm* — Dorsey & Whitney LLP

(57) ABSTRACT

The present invention is directed to a recloseable bag, comprising front and rear panels joined together along a joined region at lateral and bottom sides to define an inner pocket, the panels defining a principal opening at a top side thereof for removably receiving contents into the inner pocket; and a resealable closure having first and second lateral ends and disposed on a top side of the panels and configured for releasably joining the panels at the top side to releasably close the principal opening to retain the contents in the inner pocket wherein the front and rear panels define an assistive opening for facilitating opening of the bag for insertion and removal of the contents.

22 Claims, 3 Drawing Sheets

STACK CARRIER

CROSS REFERENCE TO RELATED APPLICATIONS

This application claims the benefit of priority from U.S. patent application Ser. No. 60/955,274, filed Aug. 10, 2007, the entire disclosure of which is incorporated herein by reference.

FIELD OF THE INVENTION

The present invention relates to a resealable bag, such as for carrying a stack.

BACKGROUND OF THE INVENTION

Stacks of sheets, such as of paper products, are traditionally sold in a paper or plastic wrapping. Index cards, for instance, are often provided enclosed in a shrink wrap. Once the wrapping is opened, it cannot readily be reused.

Resealable bags are commonly used to hold and/or transport various contents such as food, toiletries, or school/desk supplies. Typically, resealable bags are used for items that are much smaller than the bag itself and for items that take up little volume. Much of this is due to the interior space limitations imposed by the sealing structure, as there must be adequate space between the seal and the contents of the bag. Additionally, retrieving large items is cumbersome, and can result in tearing of the bag. Opening the seal can also be difficult, as it requires sliding fingers from above between the sealing components to separate them, and repeated opening of the seal weakens it and the surrounding area, rendering these susceptible to tearing. Resealable bags are also known with sliding zippers to facilitate the opening and closing process.

There is a need in the art for a resealable bag to facilitate opening and insertion and removal of contents.

SUMMARY OF THE INVENTION

Embodiments of the present invention relate to a recloseable bag having front and rear panels joined together along the lateral and bottom sides of the bag, creating an inner pocket. At their top side, the panels define a principal opening for removably receiving contents into the inner pocket. The preferred embodiment also includes a recloseable seal or closure at the top side of the panels, the closure having first and second lateral ends and configured for releasably joining the panels at the top side to releasably close the principal opening and retain the contents in the inner pocket. Between the panels is an assistive opening to facilitate opening of the bag for insertion and removal of the contents by either facilitating opening of the seal, by enlarging the opening of the inner pocket, or both. In one preferred embodiment, the opening is configured and dimensioned for receiving a user's fingers, thus permitting a user to pull apart the front and rear panels to open the closure. The opening can be disposed adjacent to the first lateral end of the closure, and can also be contiguous with the closure, thus enlarging the principal opening of the inner pocket.

The closure can further include corresponding male and female elements configured for cooperatively engaging each other upon application of pressure against each other. In another embodiment, the closure includes a zipper.

The finger opening of the bag is preferably about between 0.5 and about 2.0 inches long. The inner pocket of the bag has a height measured between the closure and the bottom side, and the finger opening has a length that is preferably about between ⅕ and ⅓ of the inner pocket height. The finger opening can be disposed at lateral edge of the bag, and when the closure is in an open configuration, the principal opening of the preferred embodiment is contiguous with the finger opening to facilitate insertion and removal of the contents. The front and rear panels can be free of each other at the finger opening.

The front and rear panels of the preferred embodiment are generally transparent and rectangular, and can include a pocket panel attached thereto to define a secondary pocket therebetween. In one embodiment, the inner pocket is configured and dimensioned for closely holding a stack of index cards to substantially retain the stack in alignment and facilitate removal of the stack from the inner pocket when the seal is open.

A stack of sheets can be contained in the inner pocket, and the sheets can be provided with a line of weakness for facilitating detachment of a label portion thereof, with the secondary pocket dimensioned for receiving the detached label portion, preferably tightly. The line of weakness can be disposed to divide the sheets in half. The stack height and width can be within about 15% of the inner pocket height and width to keep the stack substantially aligned within the interior pocket, but allowing easy removal of the stack therefrom. The area of the secondary pocket may be about half the size of the primary pocket when the bag is extended flat.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Figure 1:
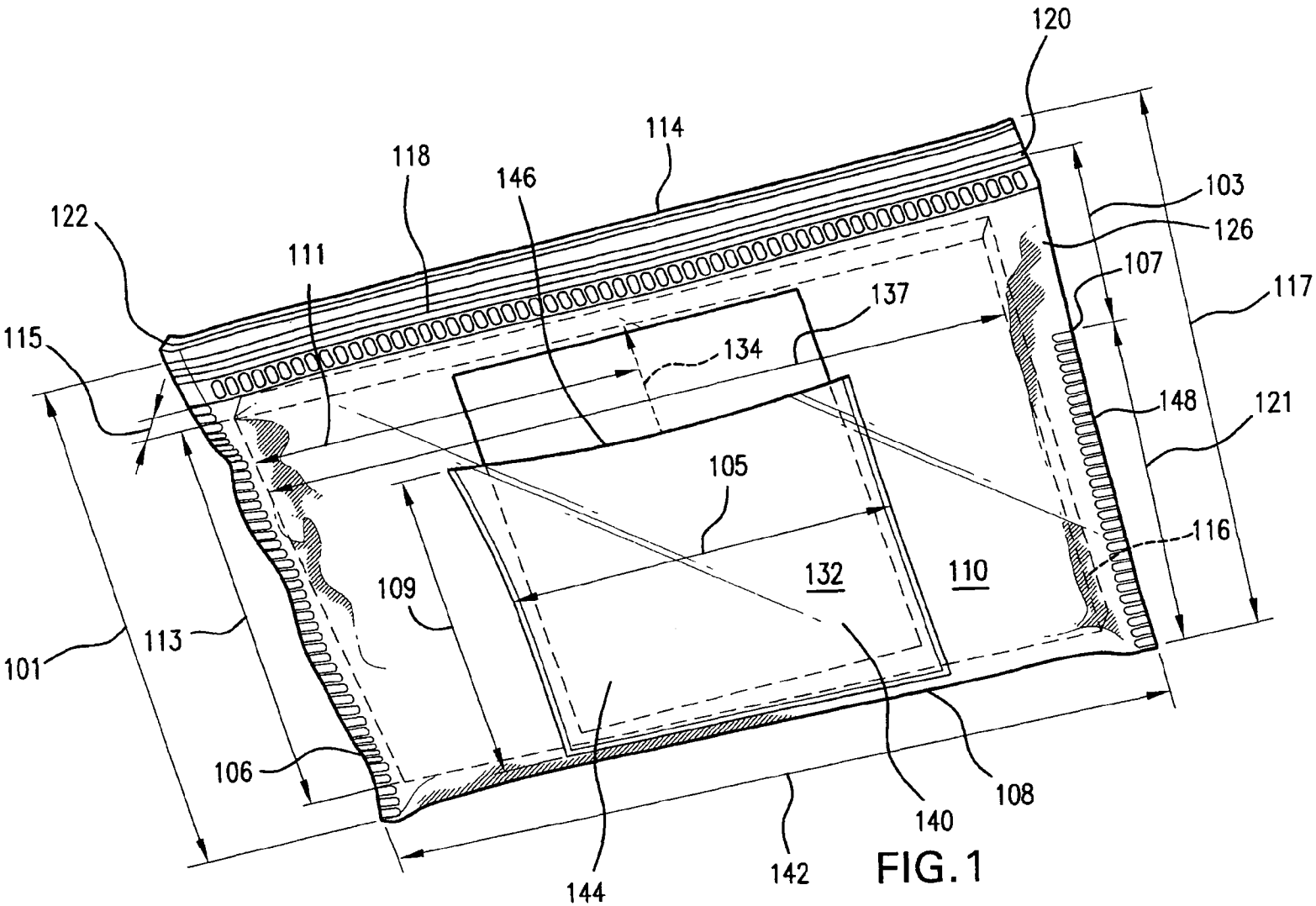
FIG. 1 is a left, front perspective view of a resealable bag constricted according to an exemplary embodiment of the invention, containing a stack of index cards and with a closure in a closed configuration.
Figure 2:
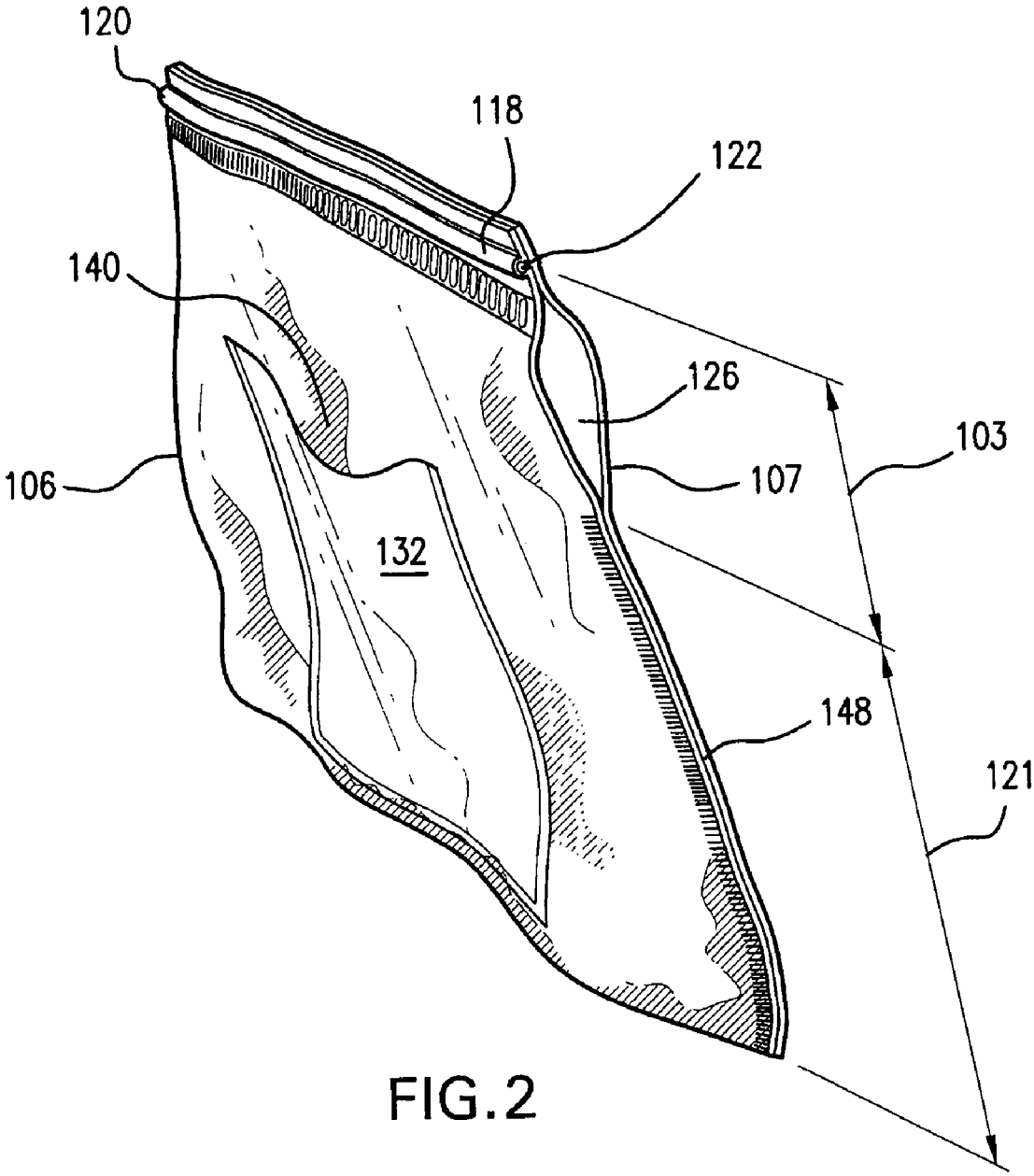
FIG. 2 is a right, front perspective view of the resealable bag.
Figure 3:
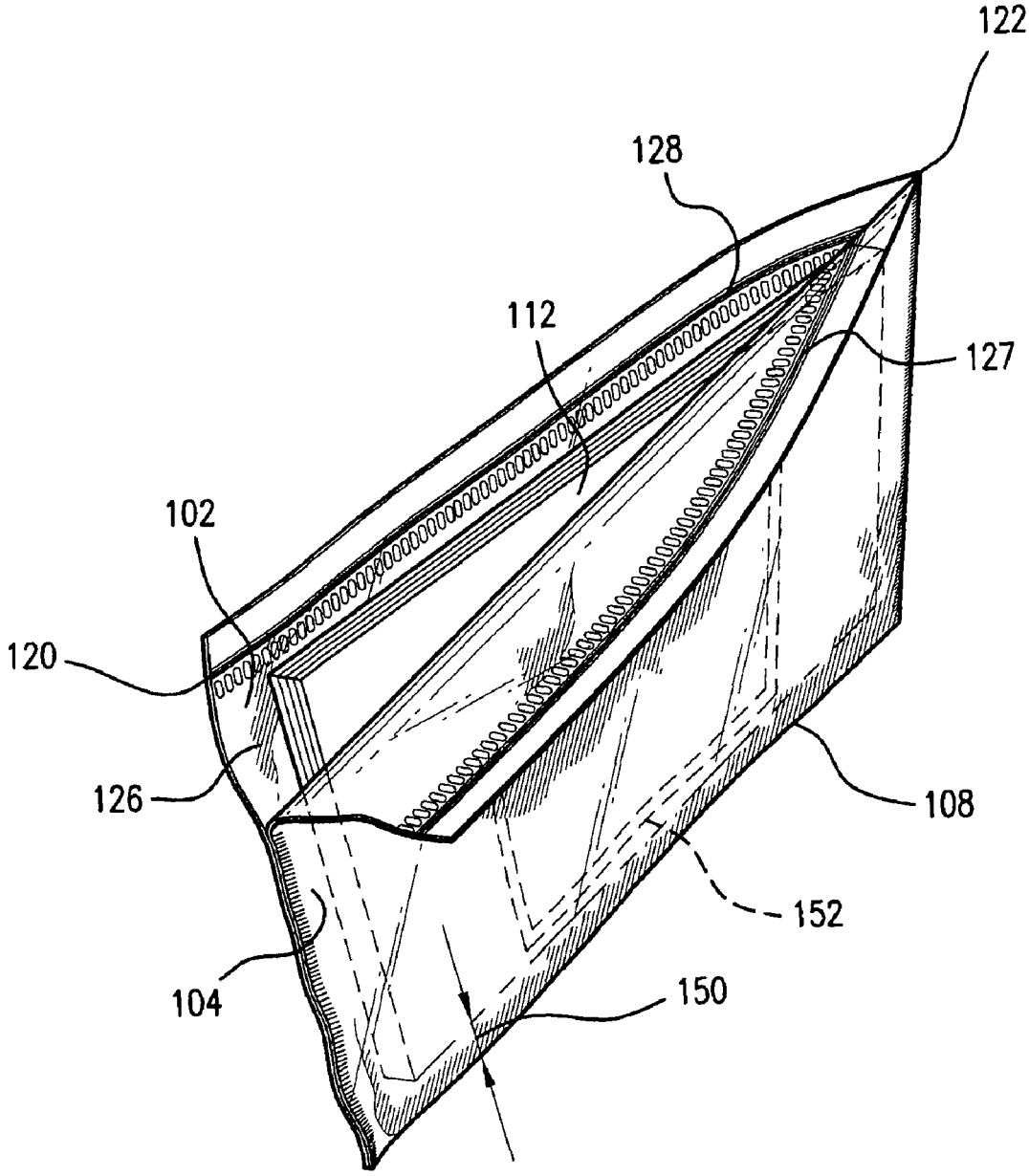
FIG. 3 is a top, left perspective view of the resealable bag with the closure in an open configuration.

As shown in FIGS. 1-3, a preferred embodiment of resealable bag 100 has front and rear panels 102, 104 joined together along lateral sides 106, 107 and bottom side 108 to define an inner pocket 110. The front and rear panels 102, 104 of this embodiment are formed from a single plastic film folded over itself on the bottom side 108 to form a bottom edge. The lateral sides 106, 107 are joined preferably by welding, such as by heat sealing or other manner of joining. In alternate embodiments, the panels can be joined in other manners, folded over a different edge, or made from separate sheets.

The panels 102, 104 define an pocket opening 112 at the top side 114, which is configured to receive contents into the inner pocket 110. Bag 100 has a closure, preferably a recloseable seal 118 with first 120 and second 122 lateral ends. The closure 118 is preferably disposed on the top side 114 of the front 102 and back 104 panels. The closure 118 allows for the panels 102 and 104 to be releasably closed and opened, thus allowing the contents to be inserted and removed from inner pocket 110 and to retain the contents in the inner pocket when closed. Closure 118 borders the top of the inner pocket 110, which has a height 101 extending from seal 118 to the bottom side 108 of the bag 100.

Closure 118 may have closure members on each of the front and rear panels 102, 104, such as male and female members 127, 128 (FIG. 3). Closure members 127, 128 can be provided in strips, such as made by extrusion, and can be heat sealed or otherwise attached to the inside of the film that corresponds to the interior of the front and real panels 102, 104. In a preferred embodiment of the invention, sealing members 127, 128 are attached to front 102 and rear 104 panels by heat-sealing. The preferred corresponding male and female closure member elements 127,128 are configured for cooperatively engaging each other upon application of pressure against each other. A suitable type of closure is a zipper seal, including with or without a slidable zipper. Additionally, other mechanisms of sealing as are known in the art can be employed with the bag 100 of the present invention.

The lateral sides 106, 107 of the panels 102 and 104 can also be welded together by heat. To ensure proper opening of the bag 100, the strength of the heat seal of the sealing members 127, 128 to panels 102, 104 is preferably stronger than the engagement between sealing members 127, 128 when closure 118 is closed. Further, the strength of the heat seal between the panels 102, 104 at lateral side 107, at the point immediately adjacent to and below the opening 126, is stronger than the engagement between sealing members 127, 128 when the closure 118 is closed. This ensures that the sealing members 127, 128 properly disengage when opening the bag, rather than a sealing member 127, 128 separating from a panel 102, 104. This also prevents tearing of the bag 100 along the lateral side 107 during opening.

The present invention includes an assistive opening 126, to facilitate opening of bag 100. The opening 126 can assist opening of the bag 100 by either facilitating the opening of closure 118, by enlarging inner pocket opening 112 so that the pocket 110 contents can be easily accessed and retrieved, or both. In a preferred embodiment of the invention, the opening 126 is a finger opening. Preferably, the opening 126 is on a different side or face of the inner pocket 110 than the closure 118. As shown in the FIGS. 1-3, closure 118 is on the front panel 102, and the opening 126 is on the lateral edge thereof 107. Other embodiments are also possible where the opening 126 is displaced from the lateral edge 107. In the illustrated embodiment of FIGS. 1-3, the opening 126 is adjacent to the closure 118, along lateral edge 107. When the opening 126 is a finger opening, a user can place his or her finger into the finger opening 126 and separate the front 102 and rear 104 panels by sliding a finger along the closure 118. As further shown in FIG. 3, when the closure 118 is open, the pocket opening 112 is contiguous with the finger opening 126. This configuration enlarges the principal opening 112 of inner pocket 110 and creates an open corner area from which the contents of the bag 100 can be easily grasped and retrieved by a user. The finger opening 126 is preferably provided by leaving a length of the front and rear panels 102, 104 enjoined, for example with a weld extending only partially along lateral edge 107, from the bottom 108 to the top edge 124 of the inner pocket 110, ending a predetermined distance below the closure 118. This welded portion 148 is shown in FIG. 1, with a height 121.

Opening 126 has a length 103 that extends from the first lateral end 120 of the closure 118 along a lateral side of the front 102 and rear 104 panels, until the point where the front 102 and real panels 104 are joined together along the lateral side of the bag. The length 103 of the opening 126 preferably is at least about ½ inch and more preferably at least about 0.75 inches, and preferably up to about three inches, more preferably up to about two inches, and most preferably up to about 1.5 inches with specific embodiments measuring about inch. The length 103 of the opening 126 is preferably between about ⅕ and ⅓ of the height 101 of inner pocket 110. In one preferred embodiment, the length 103 of the opening 126 is approximately ¼ of the height 101 of the inner pocket 110, and approximately ⅓ of the height 121 of the sealed portion 148 of the lateral side 107. The ratios of the length 103 of the opening 126 to the height 101 of the inner pocket 110 and the height 121 of the sealed portion may change with the size of the bag 100.

Bag 100 is configured to hold contents in the inner pocket 110, such as a stack of evenly sized paper sheets. In the illustrated embodiment, the sheets are index cards 116. The index cards 116 may have a line of weakness, such as perforations 134, dividing the cards 116 in half or other portions. Perforations 134 can be in a straight line or bent line along each card. As shown in FIG. 1, bag 100 can further include a pocket panel 132 joined to front panel 102 to define a secondary pocket 144 between the pocket panel 132 and front panel 102. The pocket panel 132 is joined to the front panel 102 on its lateral and bottom sides, although it can alternatively be joined on a different combination of sides if an opening other than upwards is desired. In other embodiments, the pocket panel 132 can be on the rear panel 104, or the bag 100 can have a pocket panel 132 on each of the front 102 and back 102 panels. The secondary pocket 144 is preferably sized to receive a portion of one of the sheets that has been detached at perforations 134 through secondary pocket opening 146; in the illustrated Figures, the secondary pocket 144 receives an index card half 140, which has been separated at perforations 134 extending along the narrow axis 113 of the index card half 140.

The secondary pocket 144 can have a lateral width 105 that is slightly greater than one-half of the of the lateral width 137 of index cards 116, and a height 109 that is slightly less than or approximately equal to the lateral width 105. According to one preferred embodiment of the invention, the lateral width 105 of the secondary pocket is about 2.75 inches, and the lateral width 111 of the perforated half of the index card is about 2.5 inches. The slightly greater lateral width 105 of the secondary pocket 144 as compared to the lateral width 111 of the index card half 140 allows the card half 140 to fit snugly in the secondary pocket 144. Thus, the index card half 140, when in the secondary pocket 144, is closely held in the pocket, such as in a generally fittedly secure association, while allowing easy placement and removal of the card half 140. The pocket panel 134 can also have concave top portion; such a V-shape or a semi-oval, and this concavity allows easy access to the card half 140.

According to one preferred embodiment, the height 109 of the secondary pocket 144 is about 2.5 inches, and the height 113 of the index card half is about 3 inches. The excess height of the index card half 140 as compared the to the secondary pocket 144 allows the card half 140 to be easily grasped and removed from the secondary pocket 144. The pocket panel 132 is completely or at least partially transparent, allowing any writing on the index card half 140 to be visible through the pocket panel 132.

The secondary pocket 144 may have an area about half the size of the inner pocket 110 when the bag 100 is extended or laid flat. Additional embodiments of the invention are contemplated wherein the inner pocket 110 and the secondary pocket 144 are of alternate sizes, such that the bag 100 can hold, for example, letter size paper or similar materials, and the secondary pocket 144 can hold, for example, at least one index card, a sheet of paper, or portions thereof. Additionally, the height and width dimensions outlined above can be inverted or otherwise altered such that the secondary pocket can accommodate an index card or sheet that has been separated by perforations 134 and turned sideways prior to insertion. The card or paper in the secondary pocket 144 can serve as a label, or as an aid to provide information during a presentation or while studying material.

In one embodiment, the bag is a file folder. In this embodiment, the inner pocket is large enough to accommodate letter size or legal size documents. In embodiments of the invention where the bag is configured and dimensioned to hold index cards, the index cards can be of any size, such as 3×5 or 4×6 inches, and the size of the bag 100 is just large enough to accommodate the stack of cards snugly, such that the bag is well-fitted to the size of the index cards. For example, the height 113 and lateral width 137 of the index cards 116 are preferably about 75-90%, and more preferably about 85%, of the height 101 and width 142 of the inner pocket 100. These dimensions help keep the stack 116 substantially aligned within the inner pocket 110 and allow for easy removal of the stack 116 from the pocket 110. In one embodiment, the bag holds a stack of approximately 50 index cards, and the thickness 115 of the stack 116 is approximately a ½ inch (FIG. 1). Other embodiments of the invention include bags that hold more or fewer cards, with greater or reduced thickness, respectively.

The display pocket 110 in the preferred embodiment is centered along the lateral width 142 of the bag 100 and the secondary pocket 144 is spaced slightly above the bottom edge 108 of the bag 100. This spacing 150 is selected so that the bottom of the secondary pocket 144 is positioned close to or at the height of the full stack of index cards 116 held within the inner pocket 110, to accommodate the expansion of the bag due to the stack thickness 115. Alternative positions for the secondary pocket 144 can be used. For instance, the secondary pocket 144 can be anywhere on the front panel 102, the rear panel 104, or can be present on both faces.

In the embodiment seen in FIG. 1, the bag 100 of the present invention snugly holds a stack of index cards 116. The close dimensions of the contents 112 compared to the bag 100 are advantageous to minimize sliding around of the contents 112 to keep them from becoming bent, damaged, or disorganized. An alternative bag with an assistive opening can be made in accordance with the present invention such that the bag 100 need not be tightly fitted to the contents.

With opening 126 present along the lateral side of the bag 100, closure 118 can be fairly close to the bag contents, allowing for the height 117 of the bag 100 to be reduced. The opening 126 reduces or eliminates the need for excess material height above closure 118 because a user will not be opening closure 118 from above closure 118, but rather from the side of the bag, where the opening 126 is located. In the embodiment shown, the height of index cards 113 can be at least about 85% to 90% or 95% of the height 117 of the bag 100, although alternative dimensions can be used.

When the closure members 127, 128 of closure 118 are completely separated from each other at the assistive opening 126, at least a lateral part of the top side 124 can be spread apart or pulled back to allow easy access to and exposure of at least an upper corner of the contents, thus permitting the contents to be grasped from the side of the bag 100. Without the assistive opening 126, a closure would need to be spaced further apart from the contents of the bag in order for a user to reach inside and grasp the contents. Thus, the bag 100 allows for the height of the pocket to be reduced. Additionally, the completely separated end of the closure 118 provides greater clearance with the comers of the stack, allowing a tighter fitting pocket. Thus, the depth (measure from front panel 102 to back panel 104) and lateral width dimensions of the bag 100 are also reduced. The preferred lateral width 137 of the index cards 116 is approximately 85% to 90% or 95% of the lateral width 142 of the bag 100, although alternative dimensions can be used.

In another embodiment, the assistive opening 126 can have a fastening mechanism (not shown) to close the opening 126 when the bag 100 is sealed. This feature offers an extra level of protection that may be desired when the bag 100 is being transported with other items, such as in a suitcase. The fastening mechanism can help prevent other items from penetrating the finger opening. The fastening mechanism can be any mechanism that is known in the art, such as a button or Velcro. The fastening mechanism can be located on the interior of the opening 126 (the inside of the bag), or the exterior of the bag near the lateral edge, on the front 102 and back 104 panels.

The bag 100 can also include a carrying feature attached thereto, such as a clip or loop, to facilitate holding or transport of the bag by a user. It is noted that a preferred embodiment does not include a fastening mechanism or carrying feature.

Bag 100, when the closure is 118 sealed, is water permeable. This feature may be achieved by the weld between the lateral edges 106, 107 of the front and rear panels 102, 104 being water-permeable, by opening 126 being water-permeable, and/or by the material of the bag being water-permeable.

Alternative dimensions and arrangements are also contemplated by the present invention. As shown in FIGS. 1-3, a preferred embodiment of the invention includes rectangular front 102 and rear 104 panels, and a substantially square pocket panel 132. However, the bag 100, as well as the panels 102, 104, and 132, can also be of various other shapes to accommodate various contents, such as oval, square, or trapezoidal.

The bag 100 can be transparent, translucent, or colored. Suitable materials for the various parts of the bag include, for example, PVC, Vinyl, Poly, neoprene, canvas, ballistic nylon, canvas, various cottons, microfibre, and linen. The durability and thickness of the material can vary with the intended use of the bag. For instance, when a user desires a bag that will be used only a few times before being discarded (e.g. when a food item is transported, and the item is fairly lightweight), the bag can be thin. For extended use, or for carrying bulkier items, the bag material can be thicker and sturdier.

As used in this application, the term "about" should generally be understood to refer to both the corresponding number and a range of numbers. Moreover, all numerical ranges herein should be understood to include each whole integer within the range.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A recloseable bag, comprising:

front and rear panels joined together along a joined region at lateral and bottom sides thereof to define an inner pocket such that the panels lie flat in substantially a same plane when the inner pocket is empty, the panels defining a principal opening at a top side thereof for removably receiving content into the inner pocket;

a stack of sheets disposed within the inner pocket, the sheets have a line of weakness for facilitating detachment of a label portion thereof;

a resealable closure having first and second lateral ends and disposed on a top side of the panels and configured for releasably joining the panels at the top side to releasably close the principal opening to retain the contents in the inner pocket; and a pocket panel is joined to the front panel on lateral and bottom sides to define a secondary pocket therebetween and a secondary opening on a top side thereof, the pocket panel is transparent for displaying contents disposed in the secondary pocket and the secondary pocket is dimensioned for closely receiving the detached label portion.

2. The bag of claim 1, wherein the closure comprises corresponding male and female elements configured for cooperatively engaging each other upon application of pressure against each other.

3. The bag of claim 2, wherein the closure comprises a zipper seal.

4. The bag of claim 1, wherein the bag is water permeable.

5. The bag of claim 1, wherein the panels are generally transparent and rectangular.

6. The bag of claim 1, wherein the inner pocket is configured and dimensioned to substantially retain the stack of sheets in alignment and facilitate removal of the stack from the inner pocket when the closure is open.

7. The bag of claim 1, wherein the line of weakness divides the sheets in half.

8. The bag of claim 7, wherein the secondary pocket has a width about half the size of the inner pocket when the bag is extended flat.

9. The bag of claim 1, wherein the sheets are index cards.

10. The bag of claim 1, wherein the inner pocket has an inner pocket height measured between the closure and the bottom side, and an inner pocket width measured between the lateral sides, and the stack has a height and width within about 15% of the inner pocket height and width to keep the stack substantially aligned within the inner pocket and facilitating removal of the stack therefrom.

11. The bag of claim 1, wherein:

the front and rear panels define an assistive opening therebetween that is disposed adjacent only one end of closure for permitting a user to pull apart the front and rear panels to open the closure; and with the closure in an open configuration, the principal opening is contiguous with the assistive opening for facilitating opening of the bag for insertion and removal of the contents.

12. The recloseable bag of claim 11, wherein:

the closure comprises first and second closure members that are releasably engaged with each other when the closure is in the closed configuration; and the assistive opening comprises a finger opening configured and dimensioned for receiving a user's finger or fingers to allow pulling apart the closure members to open the closure.

13. The recloseable bag of claim 11, wherein the assistive opening is associated with the closure enlarges the principal opening when the closure is in an open configuration.

14. The bag of claim 11, wherein the assistive opening is between about 0.5 and about 2.0 inches long.

15. The bag of claim 14, wherein the inner pocket has an inner pocket height measured between the closure and the bottom side, and the assistive opening has a length of about between ⅕ and ⅓ of the inner pocket height.

16. The bag of claim 11, wherein the assistive opening is disposed at lateral edge of the bag.

17. The bag of claim 11, wherein the front and rear panels are free of each other at the assistive opening.

18. The bag of claim 11, wherein the bag includes only one continuous assistive opening.

19. The bag of claim 1, wherein the joined region at the lateral sides of the front and rear panels extends to a region that is at least adjacent to the first lateral end of the resealable closure.

20. The bag of claim 1, wherein the front panel is joined directly to the rear panel absent any intervening panels.

21. The bag of claim 1, wherein the bag includes only the front and rear panels.

22. The bag of claim 1, wherein the front, rear, and pocket panels are made of plastic film joined by heat seals.

* * * * *